US010888486B2

(12) United States Patent
Baek et al.

(10) Patent No.: US 10,888,486 B2
(45) Date of Patent: Jan. 12, 2021

(54) TOE TAPPING EXERCISE EQUIPMENT

(71) Applicants: ELENSYS CO., LTD., Incheon (KR); DONG JIN PROTECH CO., LTD., Incheon (KR)

(72) Inventors: Seung Jun Baek, Daejeon (KR); Sang Soo Park, Incheon (KR)

(73) Assignees: Elensys Co., Ltd., Incheon (KR); Dong Jin Protech Co., Ltd., Incheon (KR)

( * ) Notice: Subject to any disclaimer, the term of this patent is extended or adjusted under 35 U.S.C. 154(b) by 244 days.

(21) Appl. No.: 16/091,818

(22) PCT Filed: Mar. 13, 2017

(86) PCT No.: PCT/KR2017/002657
§ 371 (c)(1),
(2) Date: Oct. 5, 2018

(87) PCT Pub. No.: WO2017/179821
PCT Pub. Date: Oct. 19, 2017

(65) Prior Publication Data

US 2019/0125611 A1 May 2, 2019

(30) Foreign Application Priority Data

Apr. 14, 2016 (KR) ..... 10-2016-0045505
Oct. 27, 2016 (KR) ..... 10-2016-0140865

(51) Int. Cl.
*A61H 1/02* (2006.01)
*A63B 23/10* (2006.01)

(52) U.S. Cl.
CPC ..... *A61H 1/0266* (2013.01); *A63B 23/10* (2013.01); *A61H 2001/027* (2013.01);
(Continued)

(58) Field of Classification Search
CPC ..... A61H 1/0266; A61H 2203/0437; A61H 2201/1666; A61H 2201/1261;
(Continued)

(56) References Cited

U.S. PATENT DOCUMENTS 2,216,764 A * 10/1940 Clark ..... A61H 1/0266 601/30
4,936,300 A * 6/1990 Funatogawa ..... A61H 1/0266 482/80

(Continued)

FOREIGN PATENT DOCUMENTS

KR 101208815 B1 * 12/2012
KR 101541356 8/2015
KR 101553066 9/2015

*Primary Examiner* — Timothy A Stanis
*Assistant Examiner* — Mayisha M Khan
(74) *Attorney, Agent, or Firm* — IPLA P.A.; James Bame

(57) ABSTRACT

A toe-tapping exercise machine includes: a foot rest part having a right foot rest adapted to seat a user's right foot thereon and a left foot rest adapted to seat the user's left foot thereon; and an operating part coupled to the foot rest part to allow toe portions of the foot rest part to tap each other, the operating part including: a driving motor for transferring rotating power; a right foot rest operator for receiving the rotating power from the driving motor to operate the right foot rest; and a left foot rest operator for receiving the rotating power from the driving motor to operate the left foot rest, the driving motor being disposed between the right foot rest operator and the left foot rest operator and having rotary shafts extended from both sides thereof.

5 Claims, 8 Drawing Sheets

(52) U.S. Cl.
CPC ..... *A61H 2201/1223* (2013.01); *A61H 2201/1261* (2013.01); *A61H 2201/1642* (2013.01); *A61H 2201/1666* (2013.01); *A61H 2203/0431* (2013.01); *A61H 2203/0437* (2013.01); *A61H 2209/00* (2013.01)

(58) Field of Classification Search
CPC .... A61H 2203/0431; A61H 2201/1223; A61H 2209/00; A61H 2201/1642; A61H 2001/027; A61H 23/006; A61H 2201/0169; A61H 1/005; A61H 2201/1215; A61H 2201/5023; A61H 2203/0425; A61H 2201/14; A61H 2201/1678; A61H 2201/169; A61H 2205/12; A61H 2201/164; A61H 2201/5097; A61H 23/0254; A61H 2201/12–1207; A61H 2201/1253; A61H 2201/1671; A61H 2201/1676; A63B 23/10; A63B 21/0059; A63B 21/157; A63B 21/4015; A63B 21/00178; A63B 21/00181; A63B 2209/00; A63B 2220/833; A63B 2071/0081; A63B 2071/009; A63B 2209/10; A63B 2220/803; A63B 2220/80; A63B 23/03516; A63B 23/03525; A63B 2023/006; A63B 23/08
USPC ..... 601/23, 27–32
See application file for complete search history.

(56) References Cited

U.S. PATENT DOCUMENTS

| | | | | |
|---|---|---|---|---|
| 5,094,226 | A * | 3/1992 | Medcalf | A61H 1/0266 601/104 |
| 6,572,568 | B2 * | 6/2003 | Huang | A61H 1/0237 601/101 |
| 6,932,778 | B2 * | 8/2005 | Hirt | A61H 1/0237 601/101 |
| 2003/0036462 | A1 * | 2/2003 | Ravikumar | A61H 1/0266 482/51 |
| 2003/0163176 | A1 * | 8/2003 | Bae | A61F 7/007 607/96 |
| 2010/0010397 | A1 * | 1/2010 | Ochi | A61H 1/0266 601/27 |
| 2010/0179460 | A1 * | 7/2010 | Tsai | A61H 15/0078 601/134 |
| 2012/0232443 | A1 * | 9/2012 | Ormsbee D.C. | A61H 1/0266 601/28 |
| 2013/0053224 | A1 * | 2/2013 | Dhanai | A63B 23/085 482/79 |
| 2016/0128889 | A1 * | 5/2016 | Sackner | A61H 1/005 601/29 |

* cited by examiner

TOE TAPPING EXERCISE EQUIPMENT

BACKGROUND

The present invention relates to a toe-tapping exercise machine, and more particularly, to a toe-tapping exercise machine that is provided with foot rests performing reciprocating motions to left and right sides to allow a user to automatically do a toe-tapping exercise.

A toe-tapping exercise is one of exercises for achieving various effects through a simple operation. For example, it is hard for people who have serious diabetes to do difficult exercises, and in this case, they simply do a toe-tapping exercise, thereby improving blood circulation of their lower bodies. As a result, their body temperature rises to enhance their body's immune and natural healing power.

The toe-tapping exercise largely has three advantages.

Firstly, blood circulation is promoted. If the toe-tapping exercise is done, energy collected to the upper body due to tension and stress is moved to the lower body, thereby activating Qi-blood circulation of the body.

Secondly, swelling of feet and legs is released. As the blood circulation is promoted, blood is frequently fed to a swollen region of the lower body, thereby releasing the swelling.

Lastly, thigh training is achieved during the exercise, thereby making thigh gap. Accordingly, the toe-tapping exercise gives big losing weight effects to women.

The toe-tapping exercise provides great effects through simple operations and is thus spotlighted from the public. Under such spotlight, many studies on the development on toe-tapping exercise machines have been made.

However, driving mechanisms of the conventional toe-tapping exercise machines are complicated in structure and are not rigid to cause noise therefrom, and therefore, there is a need to develop a new toe-tapping exercise machine capable of solving the above-mentioned problems.

On the other hand, one of the conventional toe-tapping exercise machines is disclosed in Korean Patent No. 10-1541356.

SUMMARY OF THE INVENTION

Accordingly, the present invention has been made in view of the above-mentioned problems occurring in the prior art, and it is an object of the present invention to provide a toe-tapping exercise machine that is improved in a driving mechanism, without any increment in size, thereby enhancing rotation cooperation performance of foot rests, extending rotation operating ranges of the foot rests, and minimizing hitting noise between parts.

Technical Solution

To accomplish the above-mentioned object, according to the present invention, there is provided a toe-tapping exercise machine including: a foot rest part having a right foot rest adapted to seat a user's right foot thereon and a left foot rest adapted to seat the user's left foot thereon; and an operating part coupled to the foot rest part to allow toe portions of the foot rest part to tap each other, the operating part comprising: a driving motor for transferring rotating power; a right foot rest operator for receiving the rotating power from the driving motor to operate the right foot rest; and a left foot rest operator for receiving the rotating power from the driving motor to operate the left foot rest, the driving motor being disposed between the right foot rest operator and the left foot rest operator and having rotary shafts extended from both sides thereof in such a manner as to engage with gears located in the right foot rest operator and the left foot rest operator, whereby through the rotating power of the driving motor, the right foot rest and the left foot rest rotate at the same angle of rotation and at the same number of revolutions.

According to the present invention, desirably, the right foot rest operator includes: a first driven gear for transferring the rotating power; a first link coupled to the first driven gear to transfer the rotating power and having a bar portion formed on one side thereof and a gear portion partially formed on the other side thereof; and a first foot rest driving gear adapted to engage with the gear portion of the first link to receive the rotating power; and the left foot rest operator includes: a second driven gear for transferring the rotating power; a second link coupled to the second driven gear to transfer the rotating power and having a bar portion formed on one side thereof and a gear portion partially formed on the other side thereof; and a second foot rest driving gear adapted to engage with the gear portion of the second link to receive the rotating power, whereby the first link and the second link increase amounts of rotation of the first foot rest driving gear and the second foot rest driving gear upon the rotation of the first driven gear and the second driven gear.

According to the present invention, desirably, the gear portion of the first link and the gear portion of the second link are configured to have a pair of separate gears arranged misalignedly to each other by means of springs, so that upon the change in directions of the right foot rest and the left foot rest, noise generated between the first link and the first foot rest driving gear and between the second link and the second foot rest driving gear is minimized.

According to the present invention, desirably, the operating part includes an external case having two hinge brackets formed on an outer surface thereof in such a manner as to be hinge-connected to the interior thereof, and the operating part is coupled to a base part having an operating part coupling guide member formed vertically on one surface thereof and inclined on the other surface thereof and a base coupled to the operating part coupling guide member to support the operating part coupling guide member against the ground, the base part having hinge bracket seating grooves adapted to seat the hinge brackets thereon, whereby if it is desired that the foot rest part is located vertically, the hinge brackets are seated on the hinge bracket seating grooves, and in the state where the external case is located vertically by means of the hinge brackets, the vertical surface of the operating part coupling guide member is coupled to the lower end surface of the external case to allow the user who sits on the floor or lies thereon to place his or her feet on the right foot rest and the left foot rest, and if it is desired that the foot rest part is inclinedly located, the hinge brackets are seated on the hinge bracket seating grooves, and in the state where the external case is inclinedly located by means of the hinge brackets, the inclined surface of the operating part coupling guide member is coupled to the lower end surface of the external case to allow the user who sits on a chair to place his or her feet on the right foot rest and the left foot rest.

According to the present invention, desirably, the right foot rest and the left foot rest are configured to allow the toe portions and heel portions to be fixedly spaced apart from each other around center portions thereof, so that the right foot rest and the left foot rest are extended in length.

According to the present invention, desirably, the right foot rest and the left foot rest have a right toe fixing member and a left toe fixing member located between the user's big and index toes on the toe portions thereof, the right toe fixing member and the left toe fixing member being made of a soft silicone material, being deformable according to the toe size of the user, preventing the user's feet from moving, and releasing impacts caused upon tapping.

According to the present invention, the toe-tapping exercise machine has the following advantages.

Firstly, both foot rests can be driven through only one driving motor. According to the present invention, one driving motor is provided, and the rotary shafts each having the screw thread formed thereon are extended from both sides of the driving motor. The end peripheries of the rotary shafts engage with the worm gears, and the worm gears engage with the driven gears so that both rotary shafts of the driving motor have the same number of revolutions and the same angle of rotation. Accordingly, the same number of revolutions and the same angle of rotation are applied to both foot rests, and the foot rests are driven together, thereby simplifying the parts required for driving the foot rests.

Secondly, a large angle of rotation can be generated even upon small rotation. According to the present invention, the gears for operating the foot rests are coupled to the links each having the gear portion and the bar portion. Even though the gears which transfer the driving force rotate to the small angle, accordingly, the gears for operating the foot rests rotate to the large angle by means of the links, so that even if the sizes of the parts are small, the large angle of rotation is achieved to obtain high efficiencies.

Thirdly, noise can be minimized. According to the present invention, both sides of the foot rest connectors coupled to both foot rests are fixedly located. Further, the spring is added between the two gears engaging with each other, and upon the change in the directions of both foot rests by means of connection operations, hitting noise caused by the backlash of the gears can be minimized.

Lastly, assembling can be simple. According to the present invention, the foot rest connectors have knurling structures. At the time when both foot rests are coupled to the foot rest connectors, accordingly, they can be coupled to the foot rest connectors at an arbitrary angle, not at a fixed angle.

DETAILED DESCRIPTION OF THE INVENTION

Hereinafter, the present invention will be disclosed with reference to the attached drawings. Before the present invention is disclosed and described, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure.

<Configuration of Toe-Tapping Exercise Machine>

Figure 1:
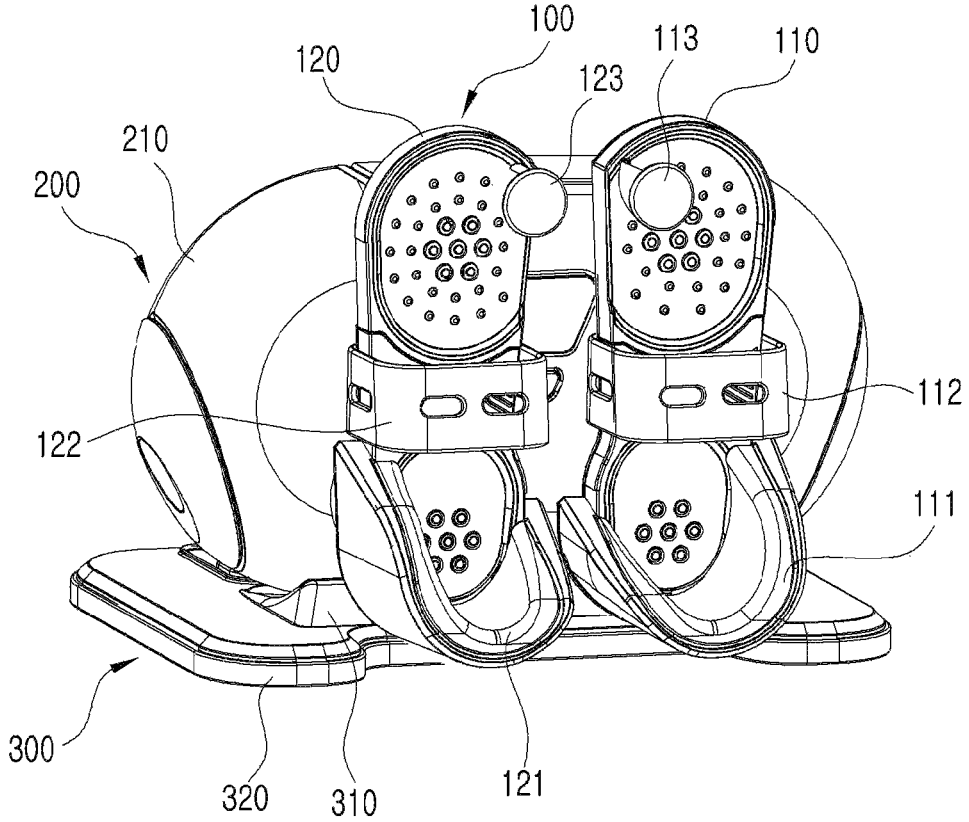
FIG. 1 is a perspective view showing a toe-tapping exercise machine according to the present invention.
Figure 2:
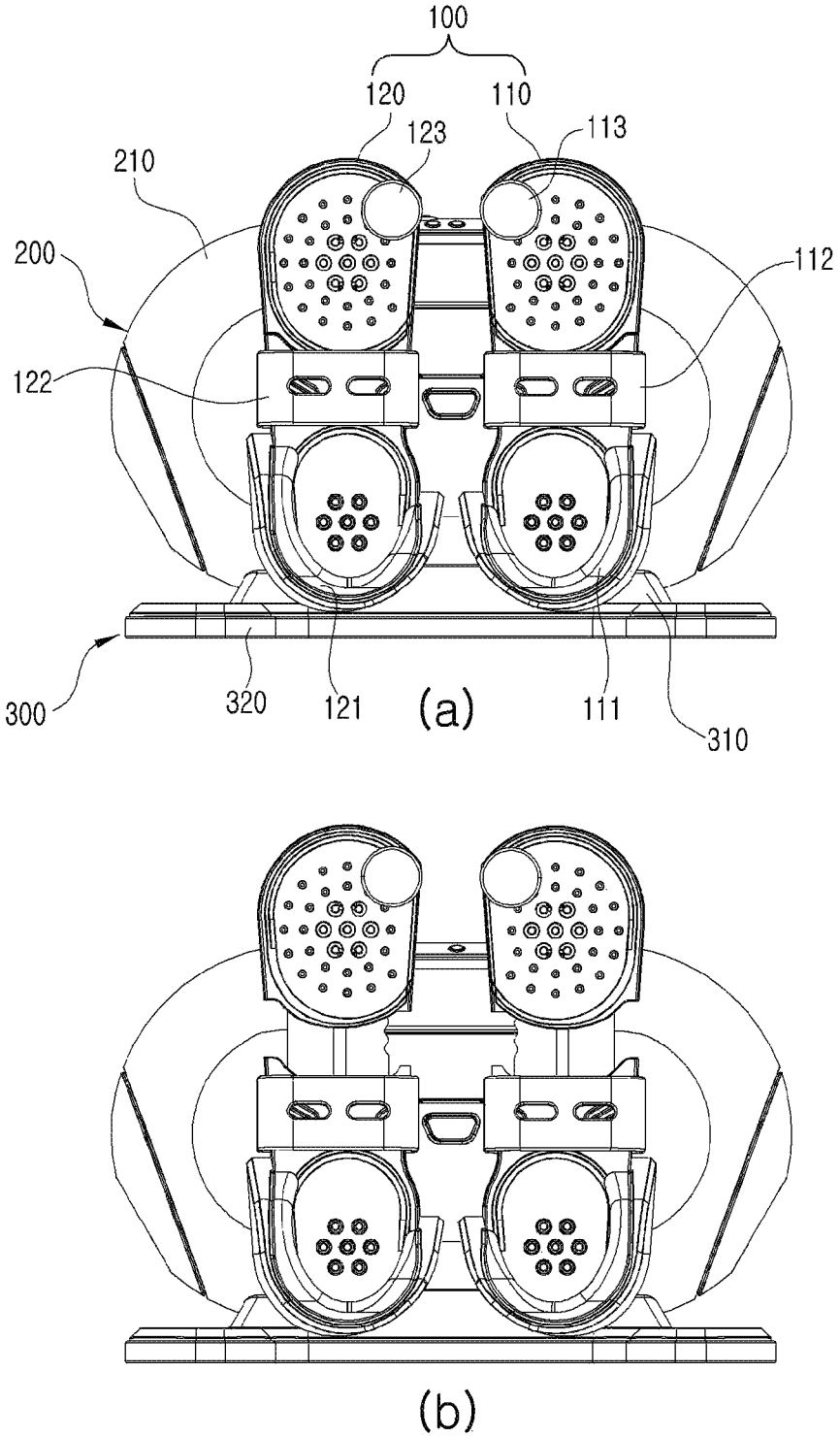
FIGS. 2*a* and 2*b* are front views showing a right foot rest and a left foot rest extended in the toe-tapping exercise machine of FIG. 1.
Figure 3:
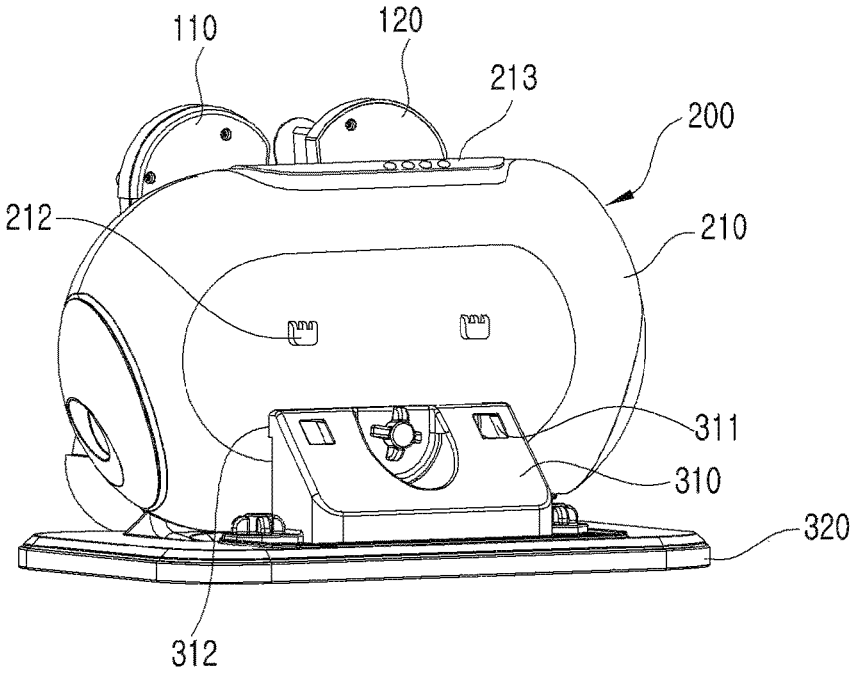
FIG. 3 is a perspective view showing the toe-tapping exercise machine of FIG. 1 when viewed on another side thereof.
Figure 4:
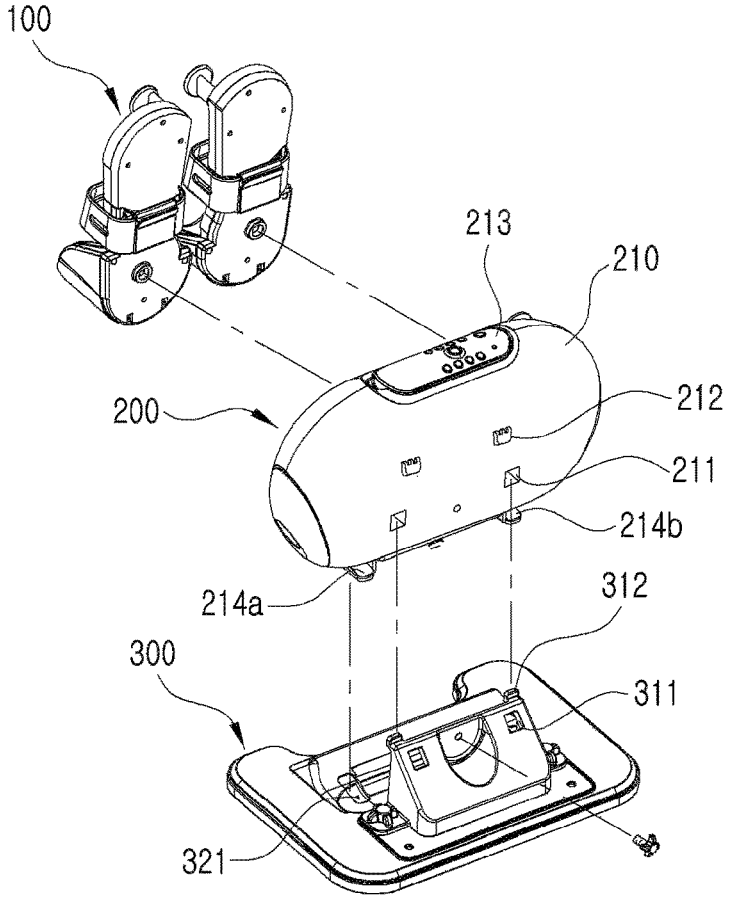
FIG. 4 is an exploded perspective view showing a foot rest part, an operating part, and a base part exploded from the toe-tapping exercise machine of FIG. 1.
Figure 5:
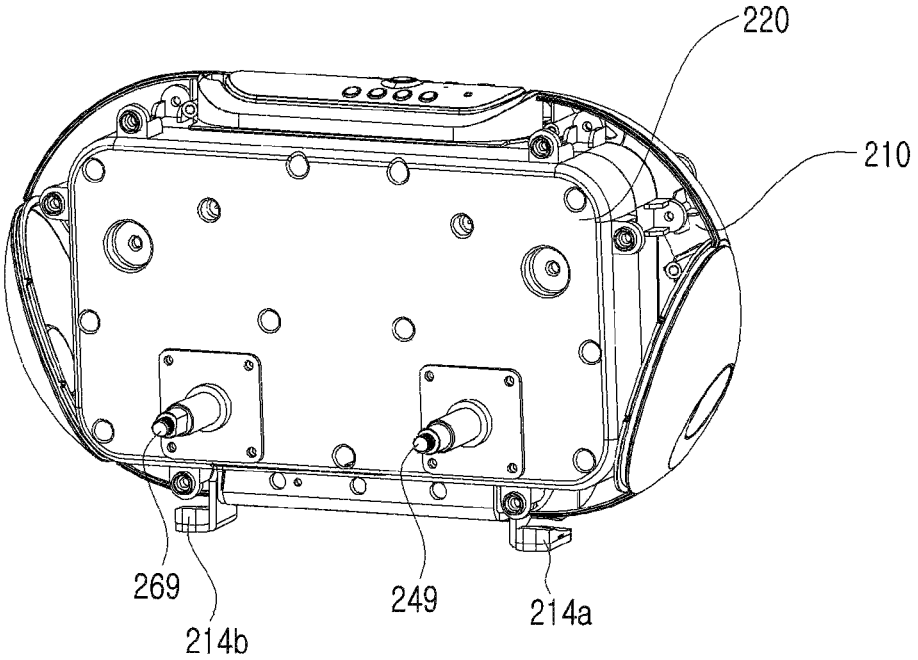
FIG. 5 is a perspective view showing an internal case and a foot rest connector after a portion of an external case is removed from the operating part of FIG. 4.
Figure 6:
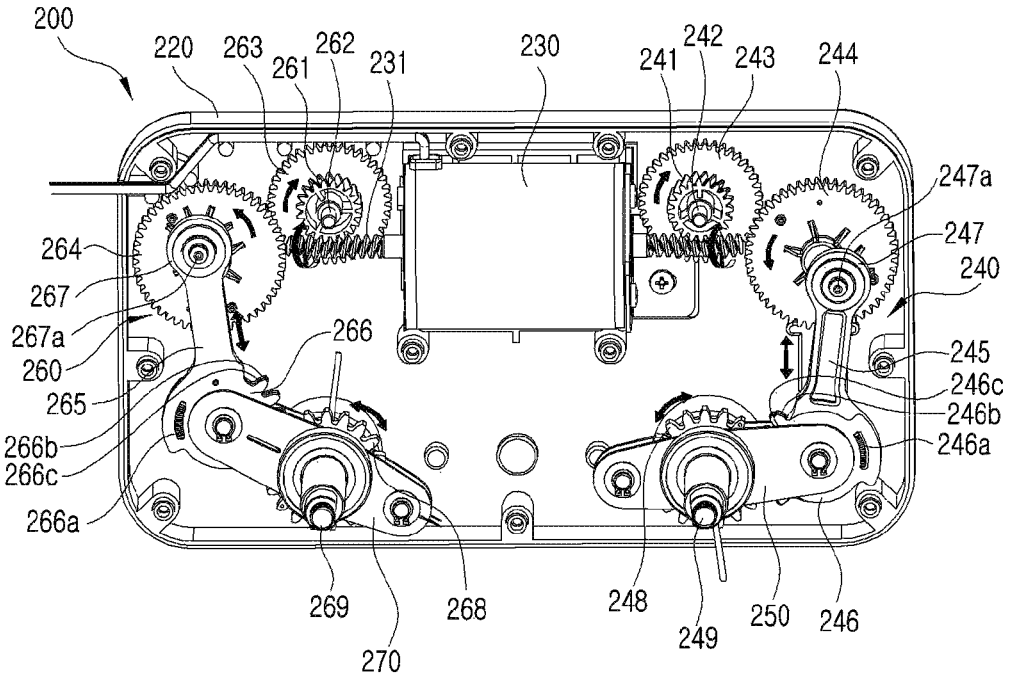
FIG. 6 is a perspective view showing an internal gear and a motor after a portion of the internal case is removed from the operating part of FIG. 4.
Figure 7:
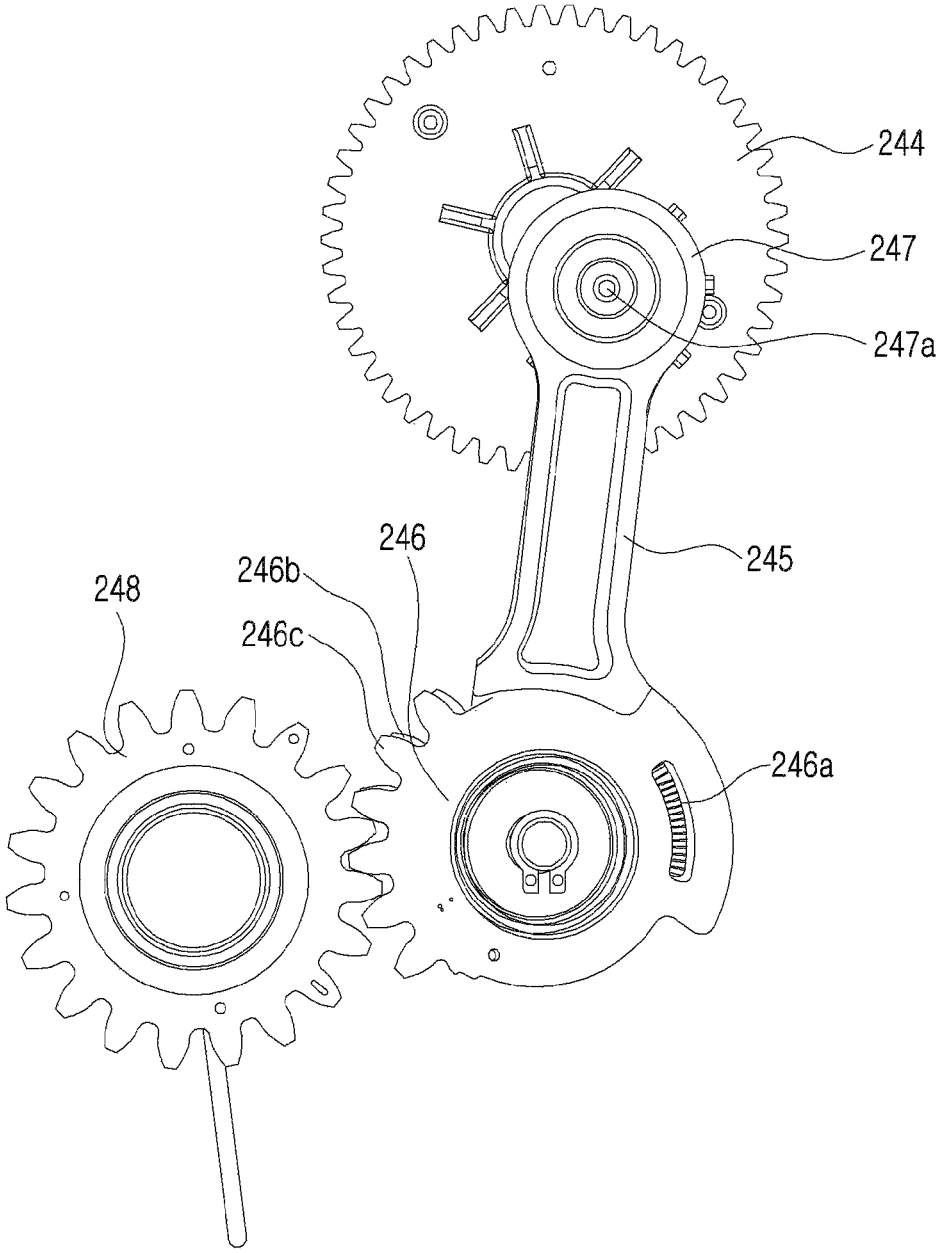
FIG. 7 is a perspective view showing a first driven gear, a first link, and a first foot rest driving gear in the operating part of FIG. 6.
Figure 8:
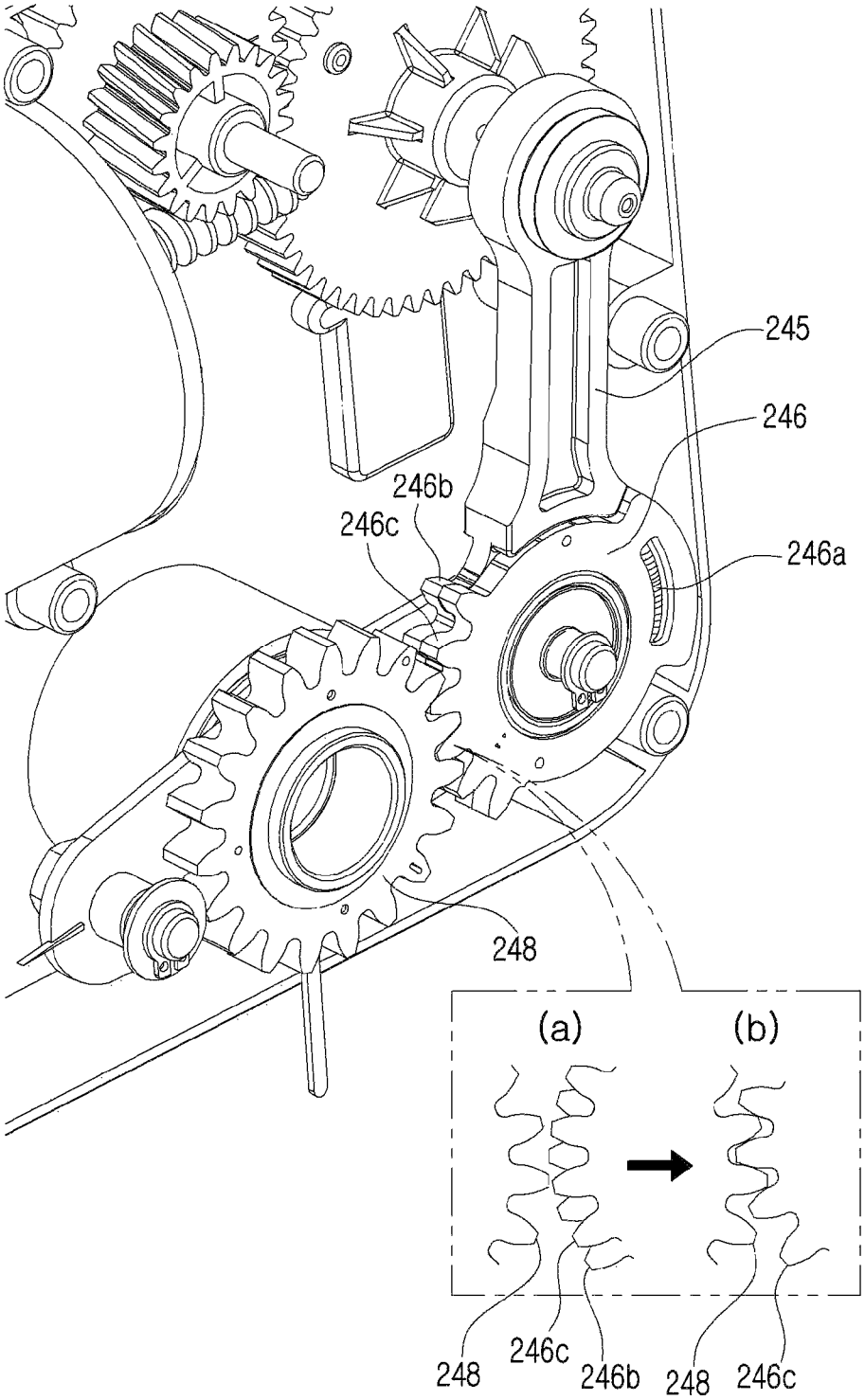
FIG. 8 is a perspective view showing a gear damping structure for the improvement of noise in the toe-tapping exercise machine according to the present invention.
Figure 9:
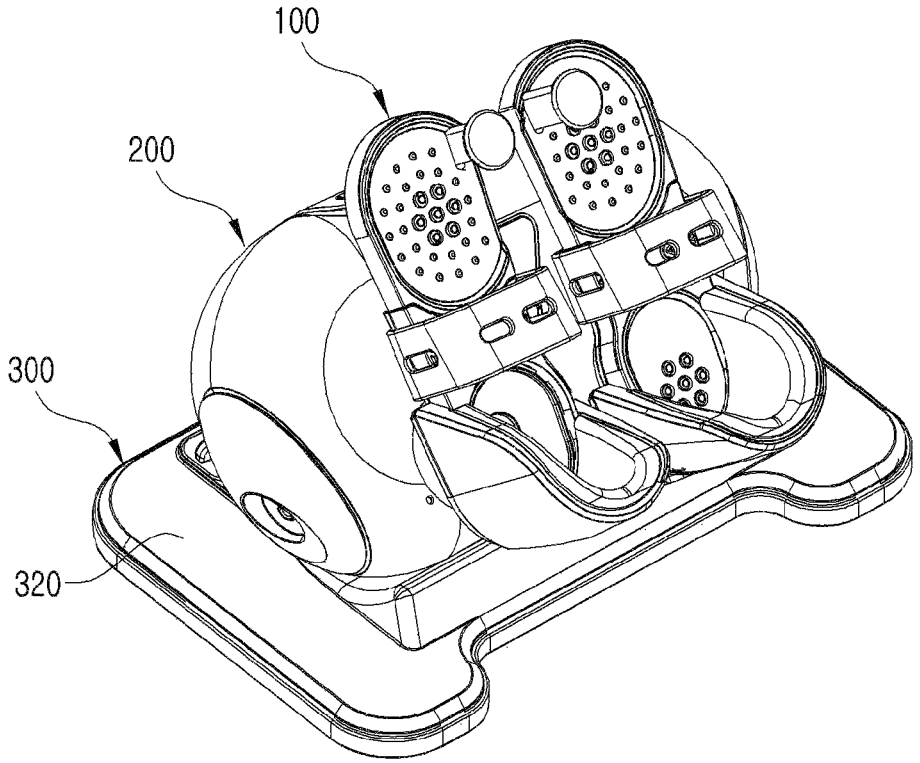
FIG. 9 is a perspective view showing the toe-tapping exercise machine according to the present invention, wherein the toe-tapping exercise machine is inclinedly located.
Figure 10:
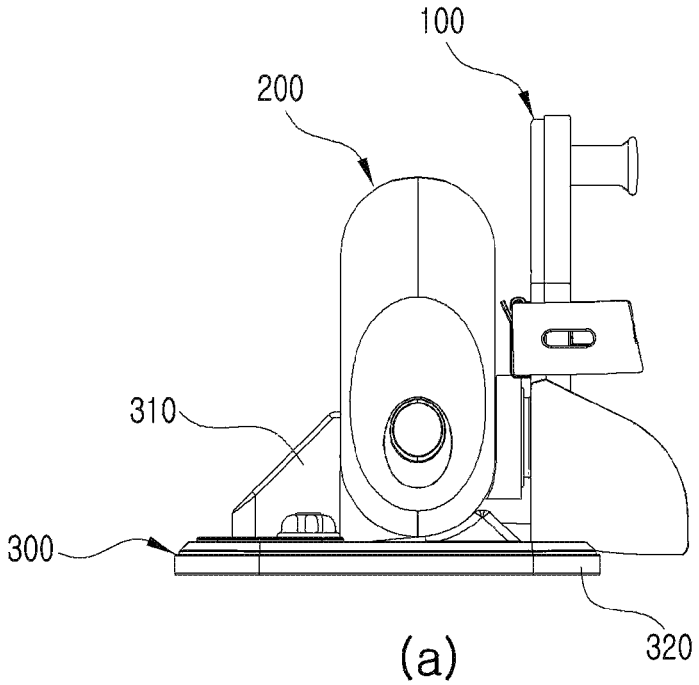
FIGS. 10*a* and 10*b* are side views showing the toe-tapping exercise machine according to the present invention, wherein the toe-tapping exercise machines are vertically or inclinedly located.
Figure 10:
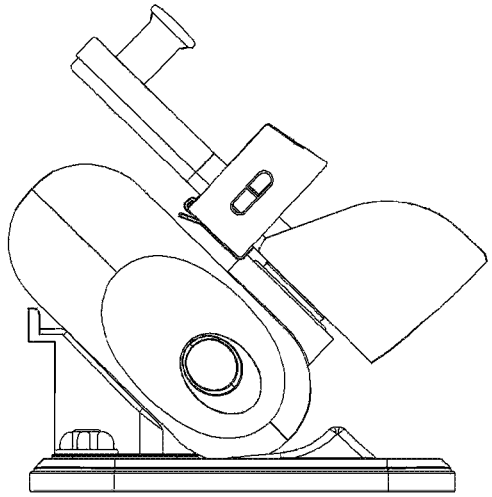

FIG. 1 is a perspective view showing a toe-tapping exercise machine according to the present invention, FIGS. 2*a* and 2*b* are front views showing a right foot rest and a left foot rest extended in the toe-tapping exercise machine of FIG. 1, FIG. 3 is a perspective view showing the toe-tapping exercise machine of FIG. 1 when viewed on another side thereof, FIG. 4 is an exploded perspective view showing a foot rest part, an operating part, and a base part exploded from the toe-tapping exercise machine of FIG. 1, FIG. 5 is a perspective view showing an internal case and a foot rest connector after a portion of an external case is removed from the operating part of FIG. 4, FIG. 6 is a perspective view showing an internal gear and a motor after a portion of the internal case is removed from the operating part of FIG. 4, FIG. 7 is a perspective view showing a first driven gear, a first link, and a first foot rest driving gear in the operating part of FIG. 6, FIG. 8 is a perspective view showing a gear damping structure for the improvement of noise in the toe-tapping exercise machine according to the present invention, FIG. 9 is a perspective view showing the toe-tapping exercise machine according to the present invention, wherein the toe-tapping exercise machine is inclinedly located, and FIGS. 10*a* and 10*b* are side views showing the toe-tapping exercise machine according to the present invention, wherein the toe-tapping exercise machines are vertically or inclinedly located.

As shown in FIGS. 1 to 10*b*, the toe-tapping exercise machine according to the present invention includes a foot rest part 100, an operating part 200, and a base part 300.

The foot rest part 100 is adapted to seat a user's feet thereon to perform a toe-tapping exercise and includes a right foot rest 110 and a left foot rest 120.

The right foot rest 110 serves to seat the user's right foot thereon and includes right heel support rubber 111, a rubber band 112, and a right toe fixing member 113. As shown in FIG. 2*b*, the right foot rest 110 is configured to allow a toe portion and a heel portion to be fixedly spaced apart from each other around a center portion thereof, so that it can be extended in length. Accordingly, the length of the right foot rest 110 is extended according to the foot size of the user.

The right heel support rubber 111 is made of a silicone material, and when the user's right foot is seated on the right foot rest 110, his or her heel is surrounded with the right heel support rubber 111, thereby making him or her feel comfortable. When the right foot rest 110 is activated, further, the heel comes into close contact with the right heel support rubber 111, thereby preventing his or her right foot from moving.

The rubber band 112 is disposed on the center portion of the right foot rest 110 and serves to fixedly surround the back of the user's right foot rigidly, thereby preventing the right foot from moving when the right foot rest 110 is activated. Instead of the rubber band 112, Velcro straps may be adopted to fix the user's right foot thereto.

The right toe fixing member 113 is located between the user's big and index toes on the toe portion of the right foot rest 110, and accordingly, the right toe fixing member 113 is fitted to the space between the big and index toes, thereby fixing the right foot thereto. The right toe fixing member 113 is made of a soft silicone material that is deformable according to the toe size of the user, so that it appropriately fixes the user's toes according to the toe size of the user and prevents the right foot from moving. Since the right toe fixing member 113 is made of the silicone material, further, impacts applied to the toes, at the time when toes of both feet tap upon the operation of the toe-tapping exercise machine, may be absorbed.

According to the present invention, on the other hand, the right foot rest 110 and the left foot rest 120 are different just in the feet seated thereon, but have the same configuration and functions as each other. Therefore, an explanation on the left foot rest 120 having left heel support rubber 121, a rubber band 122, and a left toe fixing member 123 will be avoided.

The operating part 200 is coupled to the foot rest part 100 to operate the foot rest part 100 and includes an external case 210, an internal case 220, a driving motor 230, a right foot rest operator 240, and a left foot rest operator 260.

The external case 210 is coupled to the base part 300 and has coupling holes 211 and coupling members 212 formed on a lower end surface thereof. The external case 210 has hinge brackets 214*a* and 214*b* protruding outward therefrom in such a manner as to be hinge-connected to one side of the interior thereof, and the hinge brackets 214*a* and 214*b* are coupled to a base 320 of the base part 300. An explanation on the coupling between the external case 210 and the base part 300 will be in detail given at the time when the base part 300 is described.

Further, the external case 210 has a key input part 213 and a sensor disposed on the outer surface thereof. The key input part 213 serves to set the operation of the toe-tapping exercise machine and the sensor serves to recognize commands of a remote controller. Also, the external case 210 has a gyro sensor disposed in the interior thereof so that at the time when the toe-tapping exercise machine falls down by means of a sudden movement, the power of the toe-tapping exercise machine is automatically cut off.

The internal case 220 serves to protect the motor and gears for operating the foot rest part 100 and is located inside the external case 210.

The driving motor 230 serves to provide rotating power with which the foot rest part 100 operates and is disposed between the right foot rest operator 240 and the left foot rest operator 260. The driving motor 230 includes rotary shafts 231 each having a screw thread formed thereon in such a manner as to be extended to the right foot rest operator 240 and the left foot rest operator 260 located on both sides thereof to transfer the same rotating power to the right foot rest operator 240 and the left foot rest operator 260.

The right foot rest operator 240 receives the rotating power from the driving motor 230 to operate the right foot rest 110 and includes a first top worm gear 241, a first worm gear center shaft 242, a first bottom gear 243, a first driven gear 244, a first link 245, a first foot rest driving gear 248, a right foot rest connector 249, and a first gap prevention member 250.

The first top worm gear 241 engages with the rotary shaft 231 of the driving motor 230 and thus rotates by means of the rotary shaft 231 to transfer the rotating power of the driving motor 230.

The first bottom gear 243 is formed integrally with the first top worm gear 241 on the bottom end of the first top worm gear 241 and thus rotates together with the first top worm gear 241 at the time when the first top worm gear 241 rotates.

The first worm gear center shaft 242 is fitted to the centers of the first top worm gear 241 and the first bottom gear 243 and is thus fixed to the internal case 220.

The first driven gear 244 engages with the first bottom gear 243 to transfer the rotating power of the driving motor 230.

The first link 245 is hinge-coupled to a portion of the top surface of the first driven gear 244 to transfer the rotating power of the driving motor 230 to the first foot rest driving gear 248 and has a bar portion 247 having a given length, which is coupled to the first driven gear 244 by means of a hinge 247*a*, and a gear portion 246 formed on the opposite side to the bar portion 247 in such a manner as to engage with the first foot rest driving gear 248. At this time, the gear portion 246 includes a spring 246*a* built in one side thereof and a pair of first and second gears 246*b* and 246*c* separable from each other in such a manner as to form gear teeth only over a portion of each circle in the state of being coupled to each other.

The first foot rest driving gear 248 engages with the first and second gears 246*b* and 246*c* of the gear portion 246 of the first link 245 to receive the rotating power of the driving motor 230, so that it rotates.

The right foot rest connector 249 protrudes outward from the internal case 220 in such a manner as to pass through the internal case 220 and the external case 210, and the top end periphery thereof is coupled to the right foot rest 110. Further, the right foot rest connector 249 is coupled to the center of the first foot rest driving gear 248 so that upon the rotation of the first foot rest driving gear 248, it rotates together. The right foot rest connector 249 has a knurled end periphery so that the right foot rest 110 is not coupled thereto at a fixed angle, but coupled thereto at an arbitrary angle. Upon the rotation of the first foot rest driving gear 248, accordingly, the right foot rest connector 249 coupled to the first foot rest driving gear 248 rotates, thereby allowing the right foot rest 110 to operate.

The first gap prevention member 250 is adapted to constantly maintain a distance between the first link 245 and the first foot rest driving gear 248. The first gap prevention member 250 has a pair of plates through which the right foot rest connector 249 passes in such a manner as to allow top and underside surfaces of the first link 245 and the first foot rest driving gear 248 to come into close contact with each other and to prevent the first link 245 and the first foot rest driving gear 248 from escaping from their engaging state.

On the other hand, the left foot rest operator 260 is left-right symmetrical to the right foot rest operator 240 around the driving motor 230, and since operations and functions of the parts constituting the left foot rest operator 260 are the same as those of the right foot rest operator 240, Therefore, an explanation on the left foot rest operator 260 having a second top worm gear 261, a second worm gear center shaft 262, a second bottom gear 263, a second driven gear 264, a second link 265, a second foot rest driving gear 268, a left foot rest connector 269, and a second gap prevention member 270 will be avoided.

The base part 300 serves to support the foot rest part 100 and the operating part 200 and to form an inclination of the foot rest part 100 and includes an operating part coupling guide member 310 and the base 320.

The operating part coupling guide member 310 is inclinedly formed on one surface thereof and formed vertically on the other surface thereof in such a manner as to be coupled to the lower end surface of the external case 210 of the operating part 200 to determine an inclination of the operating part 200. As a result, the inclination of the foot rest part 100 is changed according to the inclination of the operating part 200.

In detail, the operating part coupling guide member 310 has coupling holes 311 formed on the inclined surface thereof and coupling projections 312 formed on the end of the vertical surface thereof. If it is desired that the foot rest part 100 is vertically coupled, as shown in FIG. 1, the coupling projections 312 formed on the end of the operating part coupling guide member 310 are locked onto the coupling holes 211 formed on the lower end surface of the external case 210, and also, the hinge brackets 214*a* and 214*b* are seated on two hinge bracket seating grooves 321 formed on the base 320. As a result, the external case 210 is coupled vertically, and accordingly, the operating part 200 having the external case 210 is coupled vertically, so that the foot rest part 100 coupled to the operating part 200 is also coupled vertically.

Further, the foot rest part 100 inclinedly coupled as shown in FIG. 9 will be explained. In the state where the foot rest part 100 is vertically located, first, the hinge brackets 214*a* and 214*b* are fixed to the hinge bracket seating grooves 321. At this time, the operating part coupling guide member 310 is releasedly disassembled from the external case 210, and next, the coupling members 212 disposed on the lower end surface of the external case 210 are locked onto the coupling holes 311 of the operating part coupling guide member 310. After that, the operating part 200 is inclined by means of the hinge structures provided in the interior of the external case 210, and if the operating part coupling guide member 310 is coupled again to the base 320, the operating part 200 is inclinedly coupled, so that the foot rest part 100 is also inclinedly coupled.

FIGS. 10*a* and 10*b* show the vertically coupled foot rest part 100 and the inclinedly coupled foot rest part 100.

In the state where the foot rest part 100 is vertically coupled, the user who sits on the floor or lies thereon places his or her feet on the right foot rest 110 and the left foot rest 120 to do the toe-tapping exercise, and contrarily, in the state where the foot rest part 100 is inclinedly coupled, the user who sits on a chair does the exercise.

The base 320 has the two hinge bracket seating grooves 321 and is coupled to the operating part coupling guide member 310 to support the foot rest part 100 and the operating part 200 against the floor.

<Operating Process of Toe-Tapping Exercise Machine>

Now, an explanation on the operating process of the toe-tapping exercise machine according to the present invention will be given with reference to FIG. 6.

As shown in FIG. 6, if the driving motor 230 operates initially, the rotary shafts 231 rotate in directions of arrows. At this time, the first top worm gear 241 and the second top worm gear 261 engage with the screw threads formed on the rotary shafts 231, so that they rotate in a counterclockwise direction.

As the first top worm gear 241 and the second top worm gear 261 rotate, the first bottom gear 243 and the second bottom gear 263 formed integrally with the first top worm gear 241 and the second top worm gear 261 also rotate in the counterclockwise direction.

After that, the first driven gear 244 and the second driven gear 264 engaging with the first bottom gear 243 and the second bottom gear 263 rotate in a clockwise direction, and the bar portions 247 and 267 of the first link 245 and the second link 265 coupled to the top surfaces of the first driven gear 244 and the second driven gear 264 also rotate in the clockwise direction along the first driven gear 244 and the second driven gear 264.

If the bar portions 247 and 267 of the first link 245 and the second link 265 rotate in the clockwise direction, the first link 245 and the second link 265 are repeatedly ascended and descended. Accordingly, the gear portions 246 and 266 of the first link 245 and the second link 265 are also repeatedly ascended and descended.

In more detail, at the time when the gear portion 246 of the first link 245 is ascended, it pushes the first foot rest driving gear 248 in a direction of ascending the gear teeth of the first foot rest driving gear 248 on the right side of the first foot rest driving gear 248, and accordingly, the first foot rest driving gear 248 rotates in the counterclockwise direction. Contrarily, at the time when the gear portion 246 of the first link 245 is descended, it pushes the first foot rest driving gear 248 in a direction of descending the gear teeth of the first foot rest driving gear 248, and accordingly, the first foot rest driving gear 248 rotates in the clockwise direction. Accordingly, the right foot rest 110 coupled to the right foot rest connector 249 is returned from the position where the end of the foot is inclined to the left side to its original position.

On the other hand, at the time when the gear portion 266 of the second link 265 is ascended, it pushes the second foot rest driving gear 268 in a direction of ascending the gear teeth of the second foot rest driving gear 268 on the left side of the second foot rest driving gear 268, and accordingly, the second foot rest driving gear 268 rotates in the clockwise direction. Contrarily, at the time when the gear portion 266 of the second link 265 is descended, it pushes the second foot rest driving gear 268 in a direction of descending the gear teeth of the second foot rest driving gear 268, and accordingly, the second foot rest driving gear 268 rotates in the counterclockwise direction. Accordingly, the left foot rest 120 coupled to the left foot rest connector 269 is returned from the position where the end of the foot is inclined to the right side to its original position.

According to the present invention, like this, the gears rotate with the same number of revolutions and the same rotating angle as each other by means of only one driving motor 230, so that the right foot rest 110 and the left foot rest 120 are collected at the same angle and are also returned to their original state in the same manner.

In more detail, the rotary shafts 231 extended from both sides of the driving motor 230 are left and right symmetrical to each other and engage with the gears, so that as the rotary shafts 231 rotate once, the same number of revolutions is transferred to the gears disposed on both sides of the driving motor 230, and the right foot rest connector 249 and the left foot rest connector 269 as final output parts of the rotating power supplied from the driving motor 230 operate at the same angle as each other.

At this time, even if the rotary shafts 231 rotate in the opposite directions to the directions of the arrows, the toe-tapping exercise can be of course carried out. In detail, even though the rotary shafts 231 rotate in the opposite directions, the first link 245 and the second link 265 are still ascended and descended, so that the right foot rest 110 and the left foot rest 120 can be collected to each other in the same manner as mentioned above.

<Structures of Links>

According to the present invention, the gear portions 246 and 266 are formed on one side of the first link 245 and the second link 265, and the bar portions 247 and 267 are formed on the other side thereof, so that the gear portions as the output parts rotate to a large angle even upon small rotation of the gear transferring the rotation.

In more detail, as shown in FIG. 7, the bar portion 247 of the first link 245 is coupled to the center of the top surface of the first driven gear 244 by means of the hinge 247*a*, and the gear portion 246 of the first link 245 engages with the first foot rest driving gear 248.

At this time, the first driven gear 244, the first link 245, and the first foot rest driving gear 248 have a shape of a trapezoid on the plane. Accordingly, in the state where the first gap prevention member 250 maintains the distance between the first foot rest driving gear 248 and the gear portion 246, an amount of rotation of the first foot rest driving gear 248 is increased by an amount of rotation made in the state where the first foot rest driving gear 248 engages with the gear portion 246 in addition to an amount of movement of the first link 245.

If the gear portion 246 is not formed on the first link 245, the first foot rest driving gear 248 rotates only by an amount of movement of the first link 245 upon the rotation of the first driven gear 244.

According to the present invention, however, the gear portion 246 is formed on one side of the first link 245, and even if an amount of movement of the first link 245 is small, the first foot rest driving gear 248 rotates to a large angle by the amount of rotation made in the state where the first foot rest driving gear 248 engages with the gear portion 246 in addition to the amount of movement of the first link 245.

As a result, in spite of small rotation of the driving gear (that is, a small amount of movement of the first link 245), the gear on the output side rotates to a large angle, and the structure of the link having the gear portion according to the present invention provides a larger rotating angle than that having only the link.

Such structure and operation of the first driven gear 244, the first link 245 and the first foot rest driving gear 248 are the same as those in the second driven gear 264, the second link 265, and the second foot rest driving gear 268.

<Gear Damping Structure>

According to the present invention, further, a gear damping structure is provided to improve noise. As shown in FIG. 8, the gear portion 246 of the first link 245 and the gear portion 266 of the second link 265 have the first gears 246*b* and 266*b* and the second gears 264*c* and 266*c* and the springs 246*a* and 266*a* built in one side thereof.

When two gears engage with each other, typically, a spare space for backlash is formed. Accordingly, the gears are minutely spaced apart from each other while they do not rotate, but if they rotate, they engage with each other. As the gears rotate, at this time, they come into contact with each other from the state where they are spaced apart from each other by the space of the backlash, thereby causing noise due to the impact generated upon the contact.

So as to solve the problem of the noise generation, according to the present invention, the gear portions 246 and 266 of the first link 245 and the second link 265 are separated into two parts coupled misalignedly to each other, and the springs 246*a* and 266*a* are built in one side of the gear portions 246 and 266. At the time when the gear portions 246 and 266 do not engage with the first foot rest driving gear 248 and the second foot rest driving gear 268, as shown in FIG. 8*a*, the gear teeth of the first gears 246*b* and 266*b* and the second gears 246*c* and 266*c* are arranged misalignedly to each other by means of the springs 246*a* and 266*a*. However, at the time when the gear portions 246 and 266 engage with the first foot rest driving gear 248 and the second foot rest driving gear 268, as shown in FIG. 8*b*, the gear teeth of the first gears 246*b* and 266*b* and the second gears 246*c* and 266*c* come into close contact with each other by means of the tension of the springs 246*a* and 266*a* to allow the first gears 246*b* and 266*b* and the second gears 246*c* and 266*c* to be arranged alignedly to each other.

For the convenience of the description, as shown in FIG. 8, only the first link 245 and the first foot rest driving gear 248 are illustrated, but the second link 265 and the second foot rest driving gear 268, which are left-right symmetrical to the first link 245 and the first foot rest driving gear 248, have the same structure and operation as the first link 245 and the first foot rest driving gear 248.

As a result, in the state where the gear teeth of the first gears 246*b* and 266*b* and the second gears 246*c* and 266*c* of the gear portions 246 and 266 of the first link 245 and the second link 265 are misaligned to each other, the gear teeth of the first foot rest driving gear 248 and the second foot rest driving gear 268 come into close contact with the gear teeth of the first gears 246*b* and 266*b*, without any separation, and accordingly, no sudden impact is generated from the gear teeth of the first foot rest driving gear 248 and the second foot rest driving gear 268 and the gear teeth of the first gears 246*b* and 266*b*, so that the noise caused whenever the gear teeth engage with each other can be minimized.

As mentioned above, the toe-tapping exercise machine according to the present invention can drive both foot rests through only one driving motor. According to the present invention, one driving motor is provided, and the rotary shafts each having the screw thread formed thereon are extended from both sides of the driving motor. The end peripheries of the rotary shafts engage with the worm gears, and the worm gears engage with the driven gears so that both rotary shafts of the driving motor have the same number of revolutions and the same angle of rotation. Accordingly, the same number of revolutions and the same angle of rotation are applied to both foot rests 110 and 120, and the foot rests 110 and 120 are driven together, thereby simplifying the parts required for driving the foot rests 110 and 120.

Further, a large angle of rotation can be generated even upon small rotation. According to the present invention, the gears for operating the foot rests 110 and 120 are coupled to the links each having the gear portion and the bar portion. Even though the gears which transfer the driving force rotate to the small angle, accordingly, the gears for operating the foot rests 110 and 120 rotate to the large angle by means of the links, thereby providing high efficiencies with small rotating power.

Moreover, noise can be minimized. According to the present invention, both sides of the foot rest connectors 249 and 269 coupled to both foot rests are fixedly located. Further, the spring is added between the two gears engaging with each other, and upon the change in the directions of both foot rests by means of connection operations, hitting noise caused by the backlash of the gears can be minimized.

In addition, assembling can be simple. According to the present invention, the foot rest connectors 249 and 269 have knurling structures. At the time when both foot rests are coupled to the foot rest connectors, accordingly, they can be coupled to the foot rest connectors at an arbitrary angle, not at a fixed angle.

The foregoing description of the embodiments of the invention has been presented for the purpose of illustration; it is not intended to be exhaustive or to limit the invention to the precise forms disclosed. Persons skilled in the relevant art can appreciate that many modifications and variations are possible in light of the above teachings. It is therefore intended that the scope of the invention be limited not by this detailed description, but rather by the claims appended hereto.

The invention claimed is:

1. A foot and toe exercise machine comprising:

a foot rest part having a right foot rest adapted to seat a user's right foot thereon and a left foot rest adapted to seat the user's left foot thereon; and an operating part coupled to the foot rest part to allow toe portions of the foot rest part to tap each other, the operating part comprising: a driving motor for transferring rotating power; a right foot rest operator for receiving the rotating power from the driving motor to operate the right foot rest; and a left foot rest operator for receiving the rotating power from the driving motor to operate the left foot rest, the driving motor being disposed between the right foot rest operator and the left foot rest operator and having rotary shafts extended from both sides of the driving motor, wherein the right foot rest operator comprises:

a first driven gear for transferring the rotating power;

a first link coupled to the first driven gear to transfer the rotating power and having a bar portion and a gear portion; and a first foot rest driving gear adapted to engage with the gear portion of the first link to receive the rotating power;

wherein the left foot rest operator comprises:

a second driven gear for transferring the rotating power;

a second link coupled to the second driven gear to transfer the rotating power and having a bar portion and a gear portion; and a second foot rest driving gear adapted to engage with the gear portion of the second link to receive the rotating power, whereby through the rotating power of the driving motor, the right foot rest and the left foot rest rotate.

2. The foot and toe exercise machine according to claim 1, wherein the gear portion of the first link and the gear portion of the second link are configured to have a pair of separate gears arranged misalignedly to each other by springs, so that upon change in directions of the right foot rest and the left foot rest, whereby noise generated between the first link and the first foot rest driving gear and between the second link and the second foot rest driving gear is minimized.

3. The foot and toe exercise machine according to claim 1, wherein the operating part further comprises an external case having two hinge brackets formed on an outer surface of the external case.

4. The foot and toe exercise machine according to claim 1, wherein the right foot rest and the left foot rest are configured to allow the toe portions and heel portions to be fixedly spaced apart from each other.

5. The foot and toe exercise machine according to claim 4, wherein the right foot rest and the left foot rest have a right toe fixing member and a left toe fixing member adapted to be located between the user's big and index toes.

* * * * *